US009551246B2

(12) United States Patent
Rigling

(10) Patent No.: US 9,551,246 B2
(45) Date of Patent: Jan. 24, 2017

(54) ELECTROMAGNETIC ACTUATING APPARATUS

(71) Applicant: ETO Magnetic GmbH, Stockach (DE)

(72) Inventor: Timo Rigling, Moos (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/649,298

(22) PCT Filed: Oct. 30, 2013

(86) PCT No.: PCT/EP2013/072737

§ 371 (c)(1),
(2) Date: Jun. 3, 2015

(87) PCT Pub. No.: WO2014/086535

PCT Pub. Date: Jun. 12, 2014

(65) Prior Publication Data

US 2015/0322830 A1 Nov. 12, 2015

(30) Foreign Application Priority Data

Dec. 5, 2012 (DE) ..... 10 2012 111 851

(51) Int. Cl.
*F01L 9/04* (2006.01)
*F01L 25/08* (2006.01)
(Continued)

(52) U.S. Cl.
CPC ..... *F01L 25/08* (2013.01); *F01L 1/34* (2013.01); *F01L 13/0036* (2013.01);
(Continued)

(58) Field of Classification Search
CPC ..... F01L 25/08; F01L 1/34; F01L 13/0036; H01F 7/1646
(Continued)

(56) References Cited

U.S. PATENT DOCUMENTS

2011/0267159 A1* 11/2011 Schiepp ..... H01F 7/1638 335/232

FOREIGN PATENT DOCUMENTS

DE 10 2007 010 156 9/2008
DE 20 2008 008 142 12/2008
(Continued)

OTHER PUBLICATIONS

International Patent Apln. No. PCT/EP2013/072737 search report dated Dec. 12, 2013.

*Primary Examiner* — Zelalem Eshete
(74) *Attorney, Agent, or Firm* — Bachman & LaPointe, PC

(57) ABSTRACT

An electromagnetic actuator device having a core unit (12;50) having a coil means (16), which core unit is constructed for interacting with armature means (34,36,38,32, 30) that are movably guided relatively to the core unit, as a reaction to an energizing of the coil means, wherein the armature means have a plurality of tappet units (30, 32), which are spatially spaced from one another and can be driven simultaneously, to which tappet units, permanent magnet means (34) are assigned in the direction towards the core unit, which permanent magnet means have a permanent magnetization along a respective movement longitudinal axis of the tappet units, wherein the plurality of tappet units that can be driven parallel to one another magnetically interacts with an identically poled end face of the core unit and the permanent magnet means have an axially identically directed permanent magnetization.

9 Claims, 2 Drawing Sheets

(51) Int. Cl.

| | |
|---|---|
| ***F01L 1/34*** | (2006.01) |
| ***F01L 13/00*** | (2006.01) |
| ***H01F 7/16*** | (2006.01) |
| *H01F 7/08* | (2006.01) |

(52) U.S. Cl.
CPC .... *H01F 7/1646* (2013.01); *F01L 2013/0052* (2013.01); *H01F 7/081* (2013.01); *H01F 2007/1669* (2013.01)

(58) Field of Classification Search
USPC ..... 123/90.11
See application file for complete search history.

(56) References Cited

FOREIGN PATENT DOCUMENTS

| | | |
|---|---|---|
| DE | 20 2009 015 468 | 4/2010 |
| DE | 10 2009 015 486 | 9/2010 |
| DE | 10 2009 053 121 | 5/2011 |
| DE | 10 2009 056 609 | 6/2011 |
| WO | 2010063394 | 6/2010 |
| WO | 2013007403 | 1/2013 |

* cited by examiner (a)
(b)
(c)
(d)
10
12
22
24
26

A
A
28
30
32
40

(b)
10
12
14
16
18
20
22
24
26
28
30
32
34
36
38
40
42

ELECTROMAGNETIC ACTUATING APPARATUS

BACKGROUND OF THE INVENTION

The present invention relates to an electromagnetic actuation device according to the preamble of the main claim. A device of this type is known from the applicant's WO 2010/063394 A1 and describes a core unit having a coil means, which core unit is constructed for interacting with armature means that are movably guided relatively to the core unit, as a reaction to an energising of the coil means. The armature means have a plurality of tappet units, which in each case have permanent magnet means at the end thereof that are directed towards the core unit. As a reaction to the energising of the core unit and the polarity chosen for this energising, the possibility therefore arises to selectively drive individual tappet units, in that the core unit repels a respective one of the permanent magnet units by means of the electromagnetically generated flux. Thus, depending on the configuration of the device, a contra-rotating movement of a pair of tappet units for example can also be realised.

An electromagnetic actuating device for camshaft adjustment has become popular, especially in the context of internal combustion engines for automobiles. A technology of this type makes it possible in particular to engage by means of a tappet unit driven in the previously described manner into an adjustment slot constructed in a manner suitable for interaction with the tappet end and thus to effect the camshaft adjustment. In this case, an adjustment groove of this type also enables the retraction of an extended tappet unit back to a stop position on the core unit after ending energisation.

It is additionally to be assumed to be known from the prior art, for example the above-introduced prior art forming the generic type, that a plurality of tappet units is used for camshaft adjustment. Thus, it is for example known to use a first of the tappet units for camshaft adjustment along a first axial direction and a second of the tappet units for axial retraction of a correspondingly adjusted camshaft unit. In this case, it is on the one hand to be assumed to be known to assign each of these tappet units its own electromagnetic actuator, these actuators then being clocked or energised according to a respective purpose. The cited prior art according to WO 2010/063394, which forms the generic type, furthermore already described the possibility, as a reaction to the energising of only a single coil (or an arrangement of coils), of moving a plurality of tappet units simultaneously or together. In particular, the possibility is also disclosed here, of moving the plurality of tappet units (that is to say for example a pair of mutually adjacent guided tappets) simultaneously and in the same direction, wherein this presumes however, that in accordance with the polarity conditions at the described arc- or U-shaped yoke region, appropriate selected or assigned polarity conditions of the permanent magnet means must apply relatively to a respective yoke core section.

Accordingly, realisation of a multiple tappet technology is complex and furthermore entails difficulties in exact assignment during assembly.

SUMMARY OF THE INVENTION

It is therefore the object of the present invention to create an electromagnetic actuating device for simultaneously driving (moving) a plurality of tappet units from an initial position to an engagement position (for example provided by camshaft adjustment), which can be realised in a constructively simple manner and is simplified in terms of assembly and maintenance. In this case, the present invention should be suitable in particular for a use context (use purpose) in an internal combustion engine.

The object is achieved by means of the electromagnetic actuating device with the features described herein; advantageous developments of the invention also described herein.

In an advantageous manner according to the invention, the technology forming the generic type is developed in that the permanent magnet means situated at the ends of the plurality of tappet units interact with an end face (if appropriate also composed of many components) of the core unit, which is identically poled for each of the assigned tappet units, i.e. has an identical polarity at the respective times in each case.

In this respect, the present invention differs fundamentally from WO 2010/066394, which is identified as forming the generic type, as the constructive and geometric conditions there necessarily lead to differently poled end faces of the core unit being assigned for the end faces assigned to the relevant tappet units.

The property of the invention "identically poled" with regards to the end face(s) of the core unit in this case does not mean that the same cannot be changed during any operating phases of the electromagnetic actuator device according to the invention. Thus, it is included in the invention that, for example in a de-energised sate of the coil means (and as a result in the case of a lack of electromagnetic flux in the core unit), a first polarity (generated by a permanent magnet) is impressed into the end face(s) of the core unit by means of the action of the permanent magnet means of the respective tappet units, as in this respect, the core unit is part of a permanent-magnet flux circuit in the de-energised (rest) state. If, by contrast, an electromagnetic flux is generated in the core unit by means of the energising of the coil means according to the invention, this acts according to the invention (and is therefore set up with regards to the polarity of the energising) such that the common, uniform (=identically poled) polarity of the end face acts in a repelling manner against the respective permanent magnet means of the tappet unit and thus drives the same out of its initial position at the core unit into an engagement position of the respectively assigned adjustment partner.

According to the invention, this is additionally enabled in that the permanent magnet means (typically realised as permanent magnet discs, which according to a development are provided or covered at one or both ends with suitable flux-conducting disc elements) have an axially identically directed permanent magnetisation, in other words, there is no difference in direction between a direction of the permanent magnetisation of the plurality of adjacently provided permanent magnets of the respective tappet units. According to the invention, this then means that as a reaction to the energising, the plurality of tappet units is moved and driven simultaneously, synchronously and parallel to one another, the term "parallel" according to the invention not meaning with regards to the driven tappet units, that the tappet units are also moved continuously along their respective entire stroke—in the context of respective configurations of the invention, it is for example conceivable that, for example owing to various groove depths or similar conditions at the engagement partner, the tappet units perform various movement strokes up to an engagement position.

According to a preferred development of the invention, in turn in a fundamentally structural deviation from the geometric realisation principle of the technology forming the generic type according to WO 2010/063394, it is provided and advantageous, to construct the coil unit realised as a single coil surrounding an axially and centrally extending section of the core unit. If this arrangement is surrounded by a suitable approximately cupular or hollow cylindrical housing, a compact unit, which is simple to produce and magnetically powerful, is therefore created, wherein preferably and in turn according to a development the (identically poled) end face protrudes axially out of a surrounded or overlap area of the coil. In turn, alternatively or additionally, it is provided in the context of a preferred development to close one (such) housing at the end side by means of a guide element (guide section), which can then advantageously on the one hand offer guides for the plurality of tappet units (wherein the tappet units can then emerge by means of a respective end-side engagement section), on the other hand such a guide section, as part of a magnetic circuit closed for example by the housing, internally not only offers a stop for the permanent magnet means of the respective tappet units, but also can realise a bistability for the de-energised case, by means of a suitable permanent magnetic adhesive action.

In the preferred constructive-geometric configuration of the core unit, it is on the one hand provided according to a development and preferably to construct the core unit as an individual, further preferably integrally realised core element. This can then engage by means of the previously described axial central section into the (surrounded) coil and at the same time have a section extending out of the coil and radially expanding, which section then realises the identically poled end face of the core unit at the end or front side. A configuration of the invention of this type in turn connects constructive simplicity and therefore simple producibility and mountability with beneficial electromagnetic or flux-guiding properties, so that for both operating states—in the de-energised adhesive state of the tappet units and in the moving or extended state of the tappet units—optimised flux conditions are present in each case.

In particular, such a configuration of the core unit, which is widened with regards to the end face, makes it possible, in accordance with the plurality of tappet units, to generate a respective plurality of magnetic flux circuits, which can be guided in an approximately radial-edge-sided manner to a housing section correspondingly provided there and then can be closed via the housing.

An advantageous action of this type can also be realised by an alternative configuration of the core unit by means of a plurality of core units, wherein according to this realisation form, the (identically poled) end face can be realised by a plurality of further preferably flat or plate-shaped core elements, which further preferably enable an optimisation of the mechanical, geometric and magnetic conditions in the actuator device in a manner orientated to and/or designed for the magnetically assigned or interacting permanent magnet elements of the tappet units. In turn, for simple realisation of the identical polarity, it is preferred to connect the plurality of core elements (e.g. adapted to plate-shaped permanent magnet means assigned to a circumferential contour) by means of suitable flux conducting means, for example in the form of transverse or bridge pieces made from suitably magnetic-flux-conducting material, so that, analogously to the previously described principle of a one-piece or integral core element, the same magnetic action can be realised with a core composed of a plurality of elements or components.

In both configurations, the flux conducting means therefore advantageously effect a magnetic flux division into the core elements in the case of an energised coil, wherein in preferred realisations, an air gap is formed between the core elements (core end pieces).

It also emerges form the previous discussion of the advantages of the present invention compared to the prior art, which forms the generic type, that (e.g. pulsed) energising of a single polarity is sufficient for the activation of the plurality of tappet units. According to preferred developments of the invention, it is in this case also particularly provided to configure the control means connected upstream of or assigned to the coil unit such that the same can undertake the energising even in only one polarity, namely the polarity, which upon activation, in the previously described manner, causes the repelling of the plurality of tappet units to effect the simultaneous parallel movement. By contrast, it is not necessary for example, also in turn by contrast with the prior art that forms the generic type, to provide a polarity reversal of the coil means (this is based on the typical use case in particular, the resetting of the plurality of tappet units from the engagement position thereof back to the stop or bearing position at the core unit by means of the action of correspondingly constructed engagement grooves on the tappet units; this does not necessarily have to cover the complete return stroke, rather, from a predetermined reset position, in the case of de-energised coil means, the permanent magnet effect of the permanent magnet means situated at the tappet units would effect a corresponding attractive and resetting force in interaction with the core unit). According to a development, for example a suitable conical shape of the core unit (of one- or multiple-piece construction) also effects an optimisation of permanent magnetic flux circuits with regards to a resetting of the tappet units.

The advantageous unipolar configuration according to a development does not mean that in alternative developments, a reverse-poled energising to be carried out for the purpose of supporting a resetting can nevertheless take place, this is usually not necessary however for core applications of the present invention.

As a result, the present invention is therefore exceptionally suitable for realising a camshaft adjustment using a plurality of suitably engaging tappet units, wherein the present invention combines constructive simplicity and high operational reliability with beneficial maintenance and mounting properties, particularly the opportunity presents itself that with substantially standardised components, synchronous and parallel movable tappet movements can be realised.

BRIEF DESCRIPTION OF THE DRAWINGS

Further advantages, features and details of the invention result from the following description of preferred exemplary embodiments, as well as on the basis of the drawings. In the figures.

DETAILED DESCRIPTION

Figure 3:
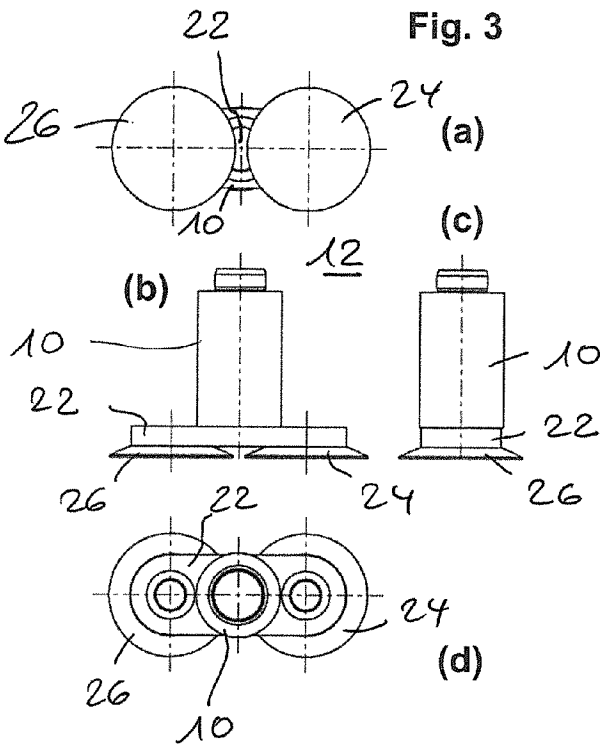
FIG. 3 shows various views of the core unit in the exemplary embodiment of FIG. 1, FIG. 2.
Figure 1:
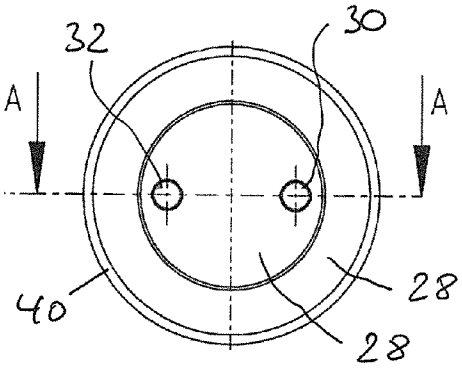
FIG. 1 shows an end-face view onto the electromagnetic actuating device according to a first embodiment of the invention with multiple-piece core unit.
Figure 2:
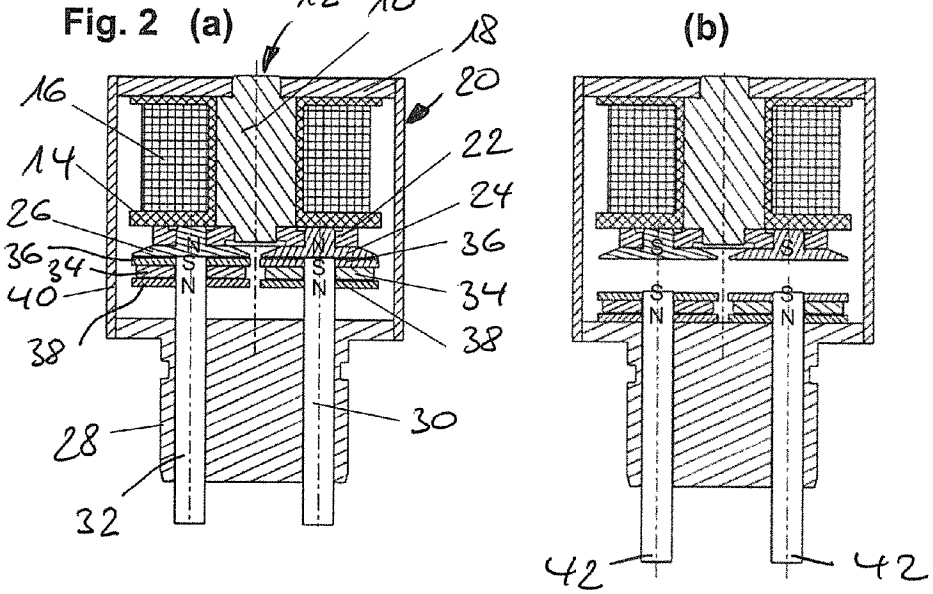
FIG. 2 shows a longitudinal sectional view along the section line A-A in the view of FIG. 1 in the de-energised state of the coil unit (a) or in the energised state and with tappet units extended into an engagement position (b)

A cylindrical core element 10 of the core unit 12, which is constructed in multiple pieces and illustrated in detail in FIG. 3, is surrounded on the shell side by a coil 16 wound on a coil carrier 14 and engages at one end into a disc-shaped base section 18 of a housing 20 of the actuating device of the first embodiment shown in FIGS. 1 to 3.

At the end of the core element 10 axially opposite the housing base 18, the same is magnetically conductively connected to a connecting or bridge piece 22 extending transversely to the axial direction (vertical direction in the figure illustration of FIG. 2), into which plate-shaped (FIG. 3) core end pieces 24, 26 magnetically conductively engage as a pair.

At the end, these form an end face of the core unit 12 essentially lying in a common plane running transversely to the longitudinal axis.

The first exemplary embodiment shown in FIGS. 1 to 3 realises an electromagnetic actuator device with a plurality of tappet units 30, 32 guided parallel to one another in a guide piece 28 axially opposite the base surface 18, wherein these extended tappets 30, 32 construct respective armature units together with a permanent magnet module, which is widened relatively to the tappet diameter, which armature units can be moved and driven along or parallel to the axial direction relatively to the core unit 12. More precisely, each of the permanent magnet modules has a disc-shaped, axially magnetised permanent magnet 34, which is covered on both sides of a magnetic-flux-conducting-disc 36, 38. According to the invention, the permanent magnetisation of the respective permanent magnet modules 34, 36, 38 of the two tappet units 30, 32 is axially identically directed, wherein in the illustration shown in FIG. 2, the permanent magnetic south pole is directed upwards and in the direction towards the core unit 12.

This arrangement of (stationary) core unit with assigned stationary coil unit 14, 16 including axially movably guided tappet/permanent magnet units opposite the same, is arranged on the shell side by a magnetically conductive, hollow cylindrical housing shell 40, which for example in the de-energised state of the coil winding 16 shown in FIG. 2(*a*), closes a permanent magnet flux of the respective magnet discs 34 radially via the discs 38 and the radially conically constructed core sections 24, 26. In this respect, the common (identically poled) polarity, shown as N-poled in FIG. 2(*a*), of the core end face formed by the units 24, 26, shows a permanent magnetisation impressed by the permanent magnets 34.

If, as shown in direct comparison in FIG. 2(*b*), a current feed is introduced into the coil winding 16, the common polarity at the end face of the core unit ("S" in the FIG.) is changed by electromagnetic action, so that a repelling force is exerted (downwards in the figure plane of FIG. 2) onto the permanent magnet discs 34 of the tappet units 30 or 32. This leads to the extended state (engagement state) shown in FIG. 2 (*b*) of the tappet units 30, 32, which engage by means of respective end-side engagement sections 42 into control grooves (not shown) of a camshaft adjusting device to be actuated by the actuating device. In addition, it can be seen from FIG. 2(*b*), that in the extended position, a respective permanent magnetic flux circuit is closed via the housing shell 40 or the end-side guide and closure element 28, so that by means of permanent magnet force, the armature units adhere in the position shown in FIG. 2(*b*), to the extent that a current-free stable extended position can also be realised in a de-energised state of the coil unit.

A resetting to the initial position of FIG. 2(*a*) takes place in the described exemplary embodiment in that the control grooves (not shown) by means of interaction with the engagement ends 42 of the tappets 30, 32 move the same back in the direction towards the core unit 12, wherein starting from a certain travel, the—de-energised—situation shown in FIG. 2 (*a*) then arises, in which by means of the permanent magnet action of the discs 34, the armature units are pulled back to the core unit or the end face thereof. This means that in the preferred exemplary embodiment, the resetting can take place without energising (particularly also without a reverse-poled energising) of the coil 16, even if, according to a development and alternatively, such a polarity reversal of this type may also support the resetting, if appropriate.

FIG. 3 clarifies constructive details of the multiple-piece core unit of the first exemplary embodiment, with its front face view (a), its rearward view (d) and its side views (b) and (c), which are tilted through 90° with respect to one another. It is shown that the disc-like elements 24, 26 are adapted, flush and in accordance with the radial diameter, to the permanent magnet modules 34, 36, 38, so that to the extent that the magnetic flux conditions are optimised, it is possible to proceed in a compact and space-saving manner. In this case, it is advantageous for production and mounting reasons, and for reasons of reliable magnetic flux, to allow the disc-shaped core elements 24, 26 to engage by means of central protrusions into adapted bores or passages of the bridge element 22, as the sectional views of FIGS. 2(*a*) and (*b*) respectively clarify.

Figure 6:
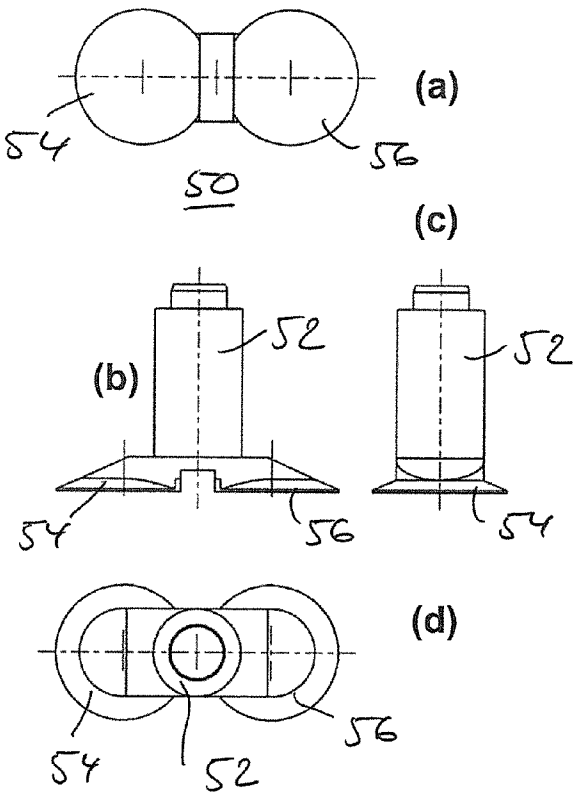
FIG. 6 shows various views of the core unit of the second exemplary embodiment according to FIG. 4, FIG. 5.
Figure 4:
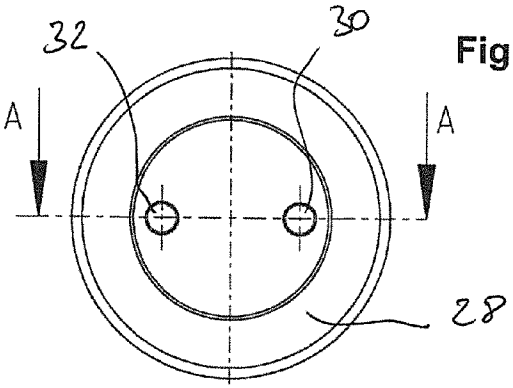
FIG. 4 shows an end-face view analogous to FIG. 1 of an electromagnetic actuating device according to a second embodiment of the invention with one-piece core unit.
Figure 5:
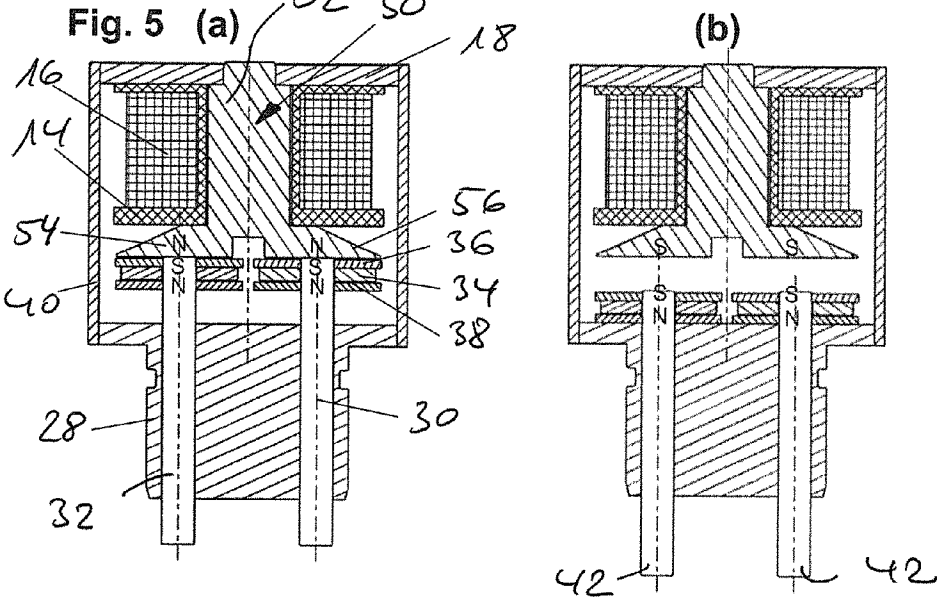
FIG. 5 shows views analogous to FIG. 3 along the section line A-A in FIG. 4 for clarifying a de-energised (a) or energised (b) state of the coil unit in a longitudinal section.

The second exemplary embodiment of FIGS. 4 to 6 describes an alternative configuration of the core unit, in an otherwise identical constructive realisation of the electromagnetic actuating device. In the constructive details of the second exemplary embodiment according to FIG. 4 to FIG. 6, in comparison with the first exemplary embodiment (FIGS. 1 to 3), identical reference numbers show identical or equivalent modules, so that only a description of the differently realised core unit takes place for the further description.

As can be seen from the sectional views of FIGS. 5 (*a*) or (*b*) in particular, the core unit 50 is constructed in one piece in FIG. 1. According to the module 10 of the first exemplary embodiment, this one-piece core unit contains a central section 52, which is adjoined by a pair of radially widened core sections 54, which, in turn provided with a conical shape 56, construct an identically poled surface for interaction with the tappet units 30, 32 or the permanent magnet modules 34, 36, 38 situated thereon. In this respect, the one-piece core unit illustrated in FIG. 6 from various views (in turn analogously to FIG. 3), achieves the same geometry and functionality as the unit of the first exemplary embodiment, which is composed of individual parts, and the functionality when the coil 16 is energised also corresponds.

Whilst the present exemplary embodiments have been illustrated as cylindrical coils with an single coil surrounding a core section and therefore cold drive a pair of tappet units synchronously and parallel, the present invention is not limited to these configurations. Rather, both a plurality of more than two tappet units can be driven, and a different geometry of the core unit, the housing shape and the guides can be imagined, so that the present invention can be applied for virtually any use purposes, beyond the described and preferred use case of camshaft adjustment.

The invention claimed is:

1. An electromagnetic actuator device having a core unit (12;50) having a coil means (16), which core unit is constructed for interacting with armature means (34,36,38,32, 30) that are movably guided relatively to the core unit, as a reaction to an energising of the coil means, wherein the armature means have a plurality of tappet units (30, 32), which are spatially spaced from one another and can be driven simultaneously, to which tappet units, permanent magnet means (34) are assigned in the direction towards the core unit, which permanent magnet means have a permanent magnetisation along a respective movement longitudinal axis of the tappet units, wherein the plurality of tappet units that can be driven parallel to one another magnetically interacts with an identically poled end face of the core unit and the permanent magnet means have an axially identically directed permanent magnetization, wherein the end face is realised with a plurality of core elements (24, 26) corresponding to the plurality of tappet units, which plurality of core elements are connected to one another mechanically via flux-conducting means (22) and in a flux-conducting manner via an electromagnetic flux of the coil means, and wherein the core elements (24, 26) are constructed in a disc-like manner and are orientated coaxially to a permanent magnet body (34) of the permanent magnet means, which is radially widened with respect to the tappet units.

2. The device according to claim 1, wherein the tappet units are guided in a guide element (28) and/or guide section, which at the end side delimits a cylindrical housing (18, 40), which surrounds the coil means.

3. The device according to claim 1, wherein the coil means have a single coil (14, 16) surrounding a section (10; 52) of the core means and the identically poled end face axially protrudes out of an overlap area of the single coil.

4. The device according to claim 1, wherein the core means have an individual core element (50), which has a diameter and/or cross-sectional dimension that widens towards the end face.

5. The device according to claim 1, wherein the core means form a cone section in the region of the end face.

6. The device according to claim 1, wherein the flux conducting means effect a magnetic flux division into the core elements, wherein an air gap is preferably formed between the core elements.

7. The device according to claim 1, wherein electrical control means are assigned to the coil means, which are constructed for controlling and/or activating the unipolarly set-up energising.

8. The device according to claim 1, wherein the coil means are set up for single-pole energising and no means for polarity reversal of the energising are connected upstream of or assigned to the coil means.

9. The device according to claim 1, wherein the tappet units are constructed for interaction with an internal combustion engine assembly for switching or actuating a camshaft adjustment unit of an internal combustion engine.

* * * * *